US006000628A

United States Patent [19]

Lorraine

[11] Patent Number: 6,000,628

[45] Date of Patent: Dec. 14, 1999

[54] FUEL INJECTOR HAVING DIFFERENTIAL PISTON FOR PRESSURIZING FUEL

[75] Inventor: Jack R. Lorraine, Newport News, Va.

[73] Assignee: Siemens Automotive Corporation, Auburn Hills, Mich.

[21] Appl. No.: 09/055,927

[22] Filed: Apr. 6, 1998

[51] Int. Cl.[6] ..... F02M 49/02

[52] U.S. Cl. ..... 239/87; 239/585.1; 417/380; 123/499; 251/129.21

[58] Field of Search ..... 239/87, 88, 95, 239/585.1, 585.4, 585.5, 533.9; 251/129.15, 129.21; 123/497, 499; 417/380, 381

[56] References Cited

U.S. PATENT DOCUMENTS

| | | | |
|---|---|---|---|
| 2,332,909 | 10/1943 | Fuscaldo . | |
| 2,569,233 | 9/1951 | Dickson et al. | 417/380 X |
| 2,595,379 | 5/1952 | Cushman | 417/380 X |
| 2,740,668 | 4/1956 | Paluch et al. | 239/87 |
| 2,759,770 | 8/1956 | Dickson . | |
| 3,093,310 | 6/1963 | Wagner . | |
| 3,106,197 | 10/1963 | Mallory | 239/87 X |
| 4,197,996 | 4/1980 | Giardini . | |
| 4,247,044 | 1/1981 | Smith . | |
| 4,306,680 | 12/1981 | Smith . | |
| 4,345,565 | 8/1982 | Bottoms | 123/499 X |
| 4,394,856 | 7/1983 | Smith et al. | 239/87 X |
| 4,427,151 | 1/1984 | Trenne . | |
| 4,955,340 | 9/1990 | E-liott . | |
| 5,484,104 | 1/1996 | Kukler | 239/87 |
| 5,775,305 | 7/1998 | Bolger | 417/380 X |

FOREIGN PATENT DOCUMENTS 1 141 566 9/1957 France .

OTHER PUBLICATIONS

International Search Report Jun. 2, 1999.

*Primary Examiner*—Andres Kashnikow
*Assistant Examiner*—Steven J. Ganey

[57] ABSTRACT

A fuel injector includes a housing having a differential piston surrounded by a coil, the differential piston carrying and surrounding an armature carrying a needle valve element. The valve seat for the needle valve is carried for movement with the differential piston. An air chamber in the injector housing communicates with the intake manifold and a fuel inlet to the fuel injector includes a check valve. At the beginning of the combustion chamber intake stroke, the differential piston is moved by a spring toward the combustion chamber, enabling the check valve to open and fuel to enter the injector fuel passages. Upon increasing pressure within the combustion chamber on the compression stroke, the differential piston is displaced to pressurize the fuel in the injector. Near the top of the compression stroke, the coil is energized and the fuel control valve is opened to inject pressurized fuel into the combustion chamber. Upon deenergization, the fuel control valve closes.

9 Claims, 2 Drawing Sheets

FUEL INJECTOR HAVING DIFFERENTIAL PISTON FOR PRESSURIZING FUEL

TECHNICAL FIELD

The present invention relates in general to fuel injectors for internal combustion engines and particularly relates to a fuel injector having a differential piston for pressurizing the fuel using the compressed air in the combustion chamber.

BACKGROUND

Fuel injectors are well known per se and typically supply fuel under pressure from a fuel pump directly to a needle valve within the injector housing. A coil surrounds an armature coupled to the needle valve. Upon energization of the coil, the needle valve is moved to a valve-open position to supply fuel under pressure to the internal combustion engine. Upon deenergization of the coil, the needle valve returns to its closed position under the bias of a spring.

In high pressure fuel systems, an external pump is conventionally used to pressurize the fuel. The pump is typically driven by an electrical motor or solenoid. In certain systems, the fuel is pressurized by a system driven mechanically off of the drive shaft. These systems, however, have proven complex and energy-inefficient.

Further, injectors are also known in which combustion chamber pressure is employed to pressurize the fuel at least to the pressure of the combustion chamber. For example, in U.S. Pat. No. 4,197,996, there is illustrated a fuel injector having a spring-biased piston having one face exposed to the pressure in the combustion chamber and the opposite face exposed to a fuel chamber within the fuel injector. During the compression stroke in the combustion cylinder, the piston within the fuel injector is displaced to pressurize the fuel to a pressure corresponding to the combustion chamber pressure level plus the force of a spring. When the coil is energized, the armature is displaced to open the valve, injecting fuel into the combustion chamber at a pressure level equal to the force of the spring. This arrangement provides a constant charge pressure to the fuel injected into the engine unaffected by changes in combustion chamber pressure levels.

DISCLOSURE OF THE INVENTION

In accordance with the present invention, a unique fuel injector construction affords a differential piston for pressurizing the fuel. The differential piston carries the armature for the needle valve for movement both with the differential piston and relative to the differential piston. To accomplish the foregoing, the fuel injector hereof includes an injector housing having a chamber for receiving fuel through a fuel inlet at one end of the housing. An inlet valve is provided adjacent the fuel inlet and is movable between open and closed positions to supply fuel to the chamber. The differential piston is movable axially within the housing and has a passage for fuel extending between opposite ends of the piston, with one end of the passage in communication with the chamber. One face of the differential piston registers with an air chamber in communication with the intake manifold of the engine, while the opposite face of the differential piston is exposed to the pressure in the combustion chamber. The differential piston is biased into a first extended position by a coil spring located in the air chamber. With the foregoing arrangement, the differential pressure on the faces of the differential piston enables the piston to move from the first position to a second retracted position to pressurize the fuel in the fuel chamber and passage. Upon the exhaust stroke in the combustion chamber, the lower pressure enables the spring in the air chamber to displace the differential piston from the second position to the first position. This latter displacement also enables the fuel inlet valve to open, permitting fuel flow into the fuel chamber.

The armature for the injector is carried within the differential piston for movement therewith and movement relative to the differential piston. The armature carries the needle valve element or plunger of the fuel flow control valve, the plunger seating on a valve seat at the end of the differential piston. The coil disposed about the differential piston and within the housing, when energized, displaces the armature and the needle valve element from a fuel control valve-closed position to a fuel control valve-open position for flowing fuel under pressure to the combustion chamber. Upon deenergization of the coil, a spring in the fuel passage returns the armature and hence the needle valve element to the valve-closed position. The location of the armature and attached needle valve within the differential piston reduces parts and assembly costs and facilitates operation of the injector.

In a preferred embodiment according to the present invention, there is provided a fuel injector for periodically flowing fuel to a combustion chamber, comprising an injector housing including a chamber for receiving fuel, a fuel inlet for supplying fuel to the chamber and an inlet valve adjacent the fuel inlet movable between open and closed positions for supplying fuel to the chamber when the inlet valve is in the open position, a differential piston movable axially within the housing between first and second positions, the differential piston having a passage for fuel extending between opposite ends thereof with one end of the passage in communication with the chamber, an air chamber within the housing for communication with an air intake manifold at substantially ambient pressure, a first face of the differential piston in part defining the air chamber and a second face of the differential piston exposed to pressure extant in the combustion chamber whereby differential pressure on the faces enables the differential piston to move from the first position to the second position to pressurize the fuel in the fuel chamber and the passage and from the second position to the first position enabling fuel flow into the fuel chamber upon movement of the fuel inlet valve to the open position thereof, an armature carried by and within the differential piston for movement therewith and movement relative to the differential piston, a fuel flow control valve including a valve seat carried by the differential piston and a valve element carried by the armature, the valve element being carried for movement with the armature and the differential piston, a coil carried by the housing about the differential piston for displacing the armature and the valve element relative to the differential piston upon energization of the coil, from a fuel control valve-closed position to a fuel flow control valve-open position for flowing fuel under pressure to the combustion chamber.

In a further preferred embodiment according to the present invention, there is provided a fuel injector for periodically flowing fuel to a combustion chamber, comprising an injector housing having a fuel passage therethrough, a fuel inlet, an inlet valve movable between open and closed positions for supplying fuel to the fuel passage when the inlet valve is in the open position and a fuel control valve for periodically supplying fuel from the injector to the combustion chamber, a differential piston movable axially within the housing between first and second positions, the differential piston having a passageway extending between opposite ends thereof and forming part of the fuel passage, an air chamber within the housing for communication with an air intake manifold at substantially ambient pressure, a first face of the differential piston in part defining the air chamber and a second face of the differential piston exposed to pressure extant in the combustion chamber whereby differential pressure on the faces enables the differential piston to move from the first position to the second position to pressurize the fuel in the passage and from the second position to the first position enabling fuel flow into the fuel passage upon movement of the fuel inlet valve to the open position thereof, an armature carried by and within the differential piston for movement therewith and movement relative to the differential piston, the fuel flow control valve including a valve seat carried by the differential piston and a valve element carried by the armature, the valve element being carried for movement with the armature and the differential piston, a coil carried by the housing about the differential piston for displacing the armature and the valve element relative to the differential piston upon energization of the coil, from a fuel control valve-closed position to a fuel flow control valve-open position for flowing fuel under pressure in the passage to the combustion chamber.

Accordingly, it is a primary object of the present invention to provide a novel and improved fuel injector of the type employing the pressure of a combustion chamber to pressurize the fuel within the injector using a differential piston which also carries therewith the armature and needle valve element actuatable by energization and deenergization of the coil surrounding the differential piston.

BEST MODE FOR CARRYING OUT THE INVENTION

Figure 1:
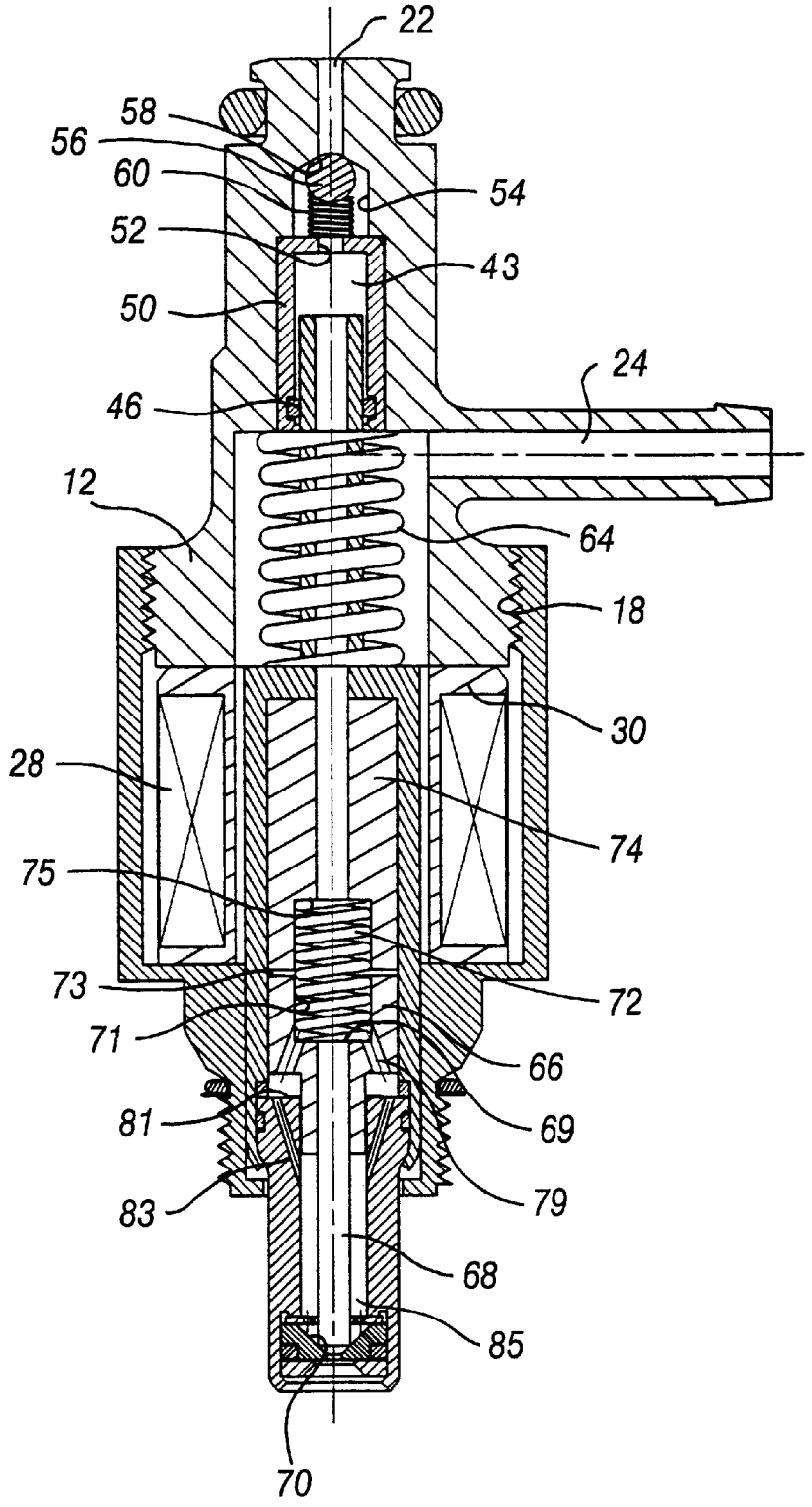
FIG. 1 is a cross-sectional view of a fuel injector constructed in accordance with the present invention.

Referring now to the drawing figures, there is provided a fuel injector, generally designated 10, including a housing 12 having an upper housing body 14 and a lower cup-shaped housing body 16 screwthreaded together at 18. The lower body 16 terminates in a projection 19 having external threads 20 which may be screwthreaded into the engine block such that the lower end of the injector 10 is in communication with the combustion chamber of the engine. The upper body 14 includes a fuel inlet 22 for supplying fuel to the fuel injector and, ultimately, the combustion chamber. The upper body 14 also includes an air passageway 24 in communication with the intake manifold for the engine whereby the air pressure in the chamber 26 within the upper body 14 is substantially at ambient pressure.

An electromagnetic coil 28 is provided within the lower body 16 in a suitably insulated mount 30. Mount 30 defines with the air chamber 26 a central passageway 31 through the injector.

In passageway 31, there is provided a differential piston 32 in the form of an inverted cylinder 35, closed at one end, e.g., its upper end except for a fuel passage 34 and open at its opposite end, e.g., its lower end, to receive a boss 36 for housing a fuel control valve, generally designated 38. The boss 36 and the lower end of the cylinder 35 of the differential piston 32 are suitably secured and sealed to one another. The differential piston 32 is slidably mounted within the injector housing without seals. Forming part of the differential piston 32 is a reduced diameter sleeve 40 having a central fuel passage 42 in communication with the fuel passage 34. The upper end of the sleeve 40 is received within an inverted cylindrical cup 50 carried by the upper body 14, the upper base of the cup 50 defining a fuel orifice 52. The sleeve 40 extends into a fuel chamber 43 within the cup 50 of upper body 14 and past a sealing ring 46 carried by cup 50. Mounted in a further chamber 54 adjacent the upper end of body 14 and above cup 50 is a spring-biased ball check valve 56. The ball valve 56 is biased against a seat 58 by a spring 60 whereby fuel under pressure entering the fuel injector by way of fuel inlet 22 may open the valve to provide fuel into the chamber 43.

A coil spring 64 biases the differential piston 32 for movement into a first position in which the boss 36 is fully extended from the lower housing 16 for exposure to the pressure in the combustion chamber. An armature 66 is mounted for movement with the differential piston 32 and also for movement relative to the differential piston 32 including projection 19. The armature 66 carries the valve element, e.g., a needle valve 68, the distal end of which seats in a closed position against a valve seat 70 at the end of the boss 36. A spring 72 bears at one end against the base 69 of a recess 71 in the upper end portion of armature 66. The opposite end of spring 72 bears against the base 75 of a recess 77 in the lower end of a member 74 fixed within the differential piston 32. Spring 72 biases the fuel control valve 38 into its closed position with the needle valve seating on seat 70. Passageways 79 in armature 66 communicate through an annular passage 81 between armature 66 and passages 83 in boss 36, in turn communicating with the annular volume 85 about needle 68. It will be appreciated that movement of the armature 66, for example, in an upward direction against the bias of spring 72, raises the sealing face of the needle valve 68 from the valve seat to open the fuel control valve 38 and closes the gap 73 between the upper end of armature 66 and the lower end of member 74.

Figure 2:
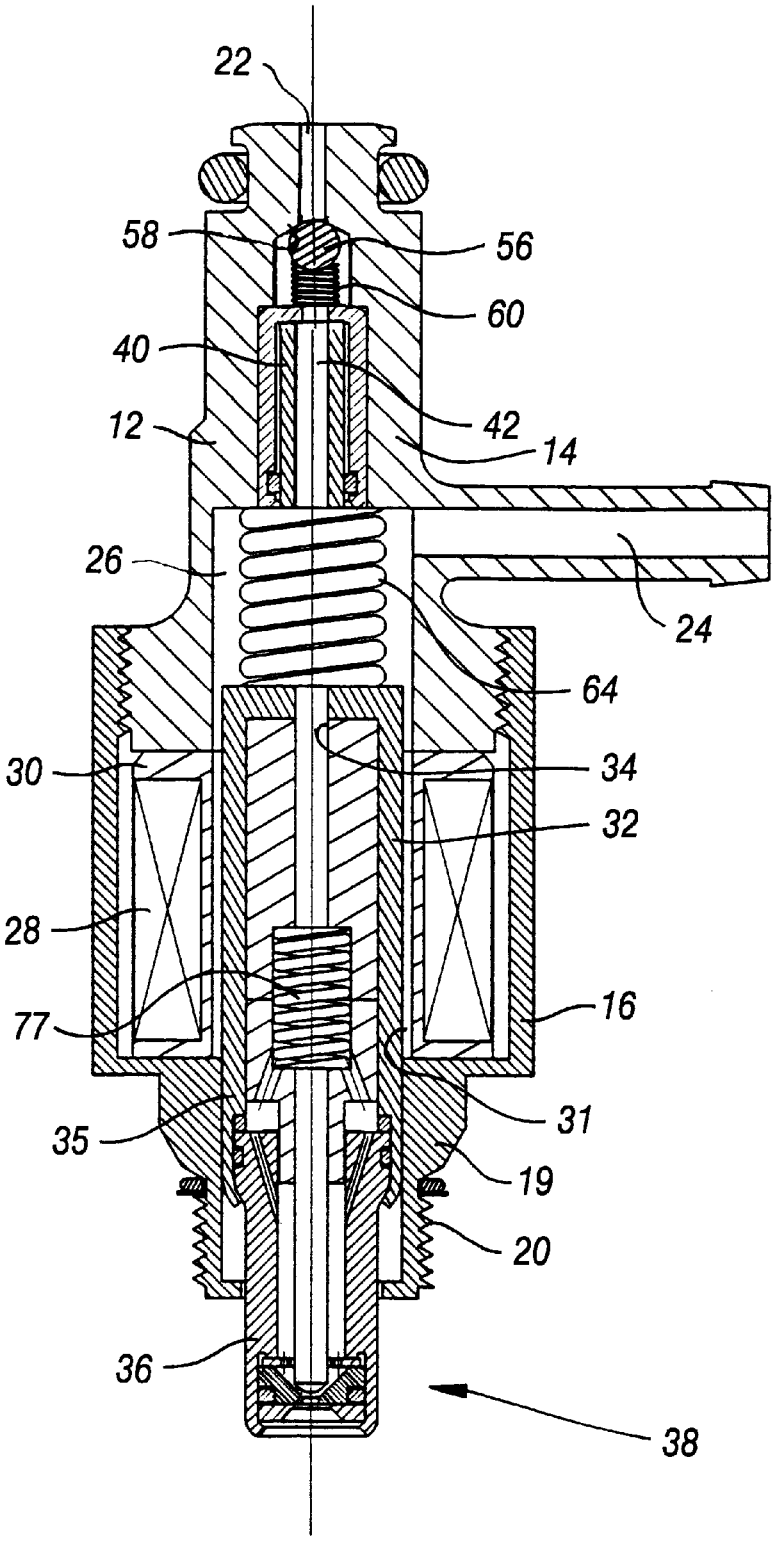
FIG. 2 is a view similar to FIG. 1 illustrating the injector at the beginning of the intake stroke of the internal combustion engine.

With the fuel injector situate in the engine with the boss 36 exposed to the pressure within the combustion chamber, the operation of the fuel injector will now be described with respect to a conventional four-stroke internal combustion engine. On the intake stroke of the combustion cylinder, air is charged into the cylinder through another valve, not shown. At the beginning of the intake stroke, it will be appreciated that the differential piston 32 lies in a second position as illustrated in FIG. 2. Also, the fuel control valve remains closed because the coil 28 remains deenergized and the spring 72 biases needle 68 to maintain its engagement against valve seat 70. As the pressure within the combustion cylinder becomes sub-atmospheric at the beginning of the intake stroke, the spring 64 moves the differential piston 32 from the second position illustrated in FIG. 2 to the first position illustrated in FIG. 1. As the differential piston 32 moves toward the first position, the check valve 56 opens to admit fuel under pressure into the fuel chamber 43. The fuel passage to the volume 85 about valve element 68 including the spring recesses 71, 75 and passages 34, 79, 81 and 83, however, remain filled with fuel from the previous fuel intake stroke. The check valve 56 then closes when the fuel pressure within the fuel injector and the spring pressure 60 applied to the ball 58 exceeds the fuel inlet pressure to the injector.

Upon the beginning of the compression stroke, the pressure in the combustion cylinder increases. The pressure on the differential piston areas exposed to the pressure of the combustion cylinder overcomes the ambient pressure applied to the opposite face of the differential piston and the pressure of spring 64. The differential piston therefore moves from the first position to the second position, i.e., its position illustrated in FIG. 1 to the position illustrated in FIG. 2. With that movement, the fuel within the injector is pressurized. At the top of the compression stroke, the coil 28 is energized and the fuel control valve 38 is opened. Particularly, the energization of coil 28 displaces the armature 66 within the differential piston 32 in a direction away from the valve seat, causing the needle tip to move away from the valve seat 70, enabling the fuel under pressure to flow through the orifice of the valve seat. Upon deenergization of the coil 28, the spring 72 returns the armature 66 to its initial position and the needle valve to the fuel control valve-closed position, seating on valve seat 70.

Substantially during the entirety of the combustion stroke, including ignition, combustion and explosion, the fuel injector remains in the condition illustrated in FIG. 2. The injector also remains in the position illustrated in FIG. 2, until it approaches the top of the exhaust stroke. At that time, the coil spring 64 displaces the differential piston from its second to its first position, opening the check valve to receive additional fuel for the next cycle.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A fuel injector for periodically flowing fuel to a combustion chamber, comprising:

an injector housing including a chamber for receiving fuel;

a fuel inlet for supplying fuel to said chamber and an inlet valve adjacent said fuel inlet movable between open and closed positions for supplying fuel to said chamber when said inlet valve is in said open position;

a differential piston movable axially within said housing between first and second positions, said differential piston having a passage for fuel extending between opposite ends thereof with one end of said passage in communication with said chamber;

an air chamber within said housing for communication with an air intake manifold at substantially ambient pressure, a first face of said differential piston in part defining said air chamber and a second face of said differential piston exposed to pressure extant in the combustion chamber whereby differential pressure on said faces enables said differential piston to move from said first position to said second position to pressurize the fuel in said fuel chamber and said passage and from said second position to said first position enabling fuel flow into said fuel chamber upon movement of said fuel inlet valve to said open position thereof;

an armature carried by and within said differential piston for movement therewith and movement relative to said differential piston;

a fuel flow control valve including a valve seat carried by said differential piston and a valve element carried by said armature, said valve element being carried for movement with said armature and said differential piston;

a coil carried by said housing about said differential piston for displacing said armature and said valve element relative to said differential piston upon energization of said coil, from a fuel control valve-closed position to a fuel flow control valve-open position for flowing fuel under pressure to the combustion chamber.

2. A fuel injector according to claim 1 including a spring in said air chamber for biasing said differential piston toward said first position hereof.

3. A fuel injector according to claim 1 including a spring carried by said differential piston for biasing said valve element into said valve-closed position.

4. A fuel injector according to claim 1 wherein said armature has a passageway forming part of said fuel passage and movable with said armature for flowing fuel to said flow control valve.

5. A fuel injector for periodically flowing fuel to a combustion chamber, comprising:

an injector housing having a fuel passage therethrough, a fuel inlet, an inlet valve movable between open and closed positions for supplying fuel to said fuel passage when said inlet valve is in said open position and a fuel control valve for periodically supplying fuel from the injector to the combustion chamber;

a differential piston movable axially within said housing between first and second positions, said differential piston having a passageway extending between opposite ends thereof and forming part of said fuel passage;

an air chamber within said housing for communication with an air intake manifold at substantially ambient pressure, a first face of said differential piston in part defining said air chamber and a second face of said differential piston exposed to pressure extant in the combustion chamber whereby differential pressure on said faces enables said differential piston to move from said first position to said second position to pressurize the fuel in said passage and from said second position to said first position enabling fuel flow into said fuel passage upon movement of said fuel inlet valve to said open position thereof;

an armature carried by and within said differential piston for movement therewith and movement relative to said differential piston;

said fuel flow control valve including a valve seat carried by said differential piston and a valve element carried by said armature, said valve element being carried for movement with said armature and said differential piston;

a coil carried by said housing about said differential piston for displacing said armature and said valve element relative to said differential piston upon energization of said coil, from a fuel control valve-closed position to a fuel flow control valve-open position for flowing fuel under pressure in said passage to the combustion chamber.

6. A fuel injector according to claim 5 including a spring carried by said housing for biasing said differential piston toward said first position thereof.

7. A fuel injector according to claim 5 including a spring carried by said differential piston for biasing said valve element into said valve-closed position.

8. A fuel injector according to claim 5 wherein said armature has a passageway portion forming part of said passageway through said differential piston.

9. A fuel injector according to claim 8 wherein said differential piston includes a boss carried thereby and carrying said valve seat, said valve element defining an annular chamber with said boss forming part of said fuel passage through the injector, and a passageway portion in said boss in communication with the passageway portion of said armature for flowing fuel to said annular chamber.

* * * * *